US009659521B2

(12) United States Patent
Satake

(10) Patent No.: US 9,659,521 B2
(45) Date of Patent: May 23, 2017

(54) COLOR CONTROL METHOD

(71) Applicant: YAZAKI CORPORATION, Tokyo (JP)

(72) Inventor: Shuuji Satake, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 153 days.

(21) Appl. No.: 14/843,318

(22) Filed: Sep. 2, 2015

(65) Prior Publication Data

US 2015/0379941 A1 Dec. 31, 2015

Related U.S. Application Data

(63) Continuation of application No. PCT/JP2014/055568, filed on Mar. 5, 2014.

(30) Foreign Application Priority Data

Mar. 6, 2013 (JP) ..... 2013-044361
Feb. 27, 2014 (JP) ..... 2014-036357

(51) Int. Cl.
*G09G 3/20* (2006.01)
*G09G 3/32* (2016.01)
*G09G 3/34* (2006.01)

(52) U.S. Cl.
CPC ..... *G09G 3/2014* (2013.01); *G09G 3/2003* (2013.01); *G09G 3/32* (2013.01);
(Continued)

(58) Field of Classification Search
CPC ..... F21Y 2115/10; F21Y 2105/10; F21Y 2113/13; G09G 2320/0242;
(Continued)

(56) References Cited

U.S. PATENT DOCUMENTS 8,760,386 B2 * 6/2014 An ..... G09G 3/3696 345/102
2002/0075136 A1 6/2002 Nakaji et al.
(Continued)

FOREIGN PATENT DOCUMENTS

JP 4-211295 A 8/1992
JP 7-28427 A 1/1995
(Continued)

OTHER PUBLICATIONS

International Search Report and Written Opinion of the International Search Report for PCT/JP2014/055568 dated Jun. 3, 2014.

*Primary Examiner* — Sanjiv D Patel
(74) *Attorney, Agent, or Firm* — Kenealy Vaidya LLP

(57) ABSTRACT

Provided is a color control method that allows for a smooth modification of various display colors without using a huge number of parameters. When a duty ratio is changed from a pre-modified duty ratio (Ds) to a post-modified duty ratio (Df) over a color modification time (Td) from the start to the end of a color modification, the modified duty ratio (Dn) is determined through a calculation using equation for a fade-in process and equation for a fade-out process. Determining the modified duty ratio (Dn) in this manner can modify colors smoothly while reducing emergence of any unnatural colors.

4 Claims, 3 Drawing Sheets

(52) U.S. Cl.
CPC ... *G09G 3/3413* (2013.01); *G09G 2300/0452* (2013.01); *G09G 2310/066* (2013.01); *G09G 2320/0242* (2013.01); *G09G 2320/0271* (2013.01); *G09G 2320/064* (2013.01); *G09G 2320/0666* (2013.01)

(58) Field of Classification Search
CPC ..... G09G 2320/0666; G09G 2320/064; G09G 2340/06; G09G 3/2014; G09G 3/32; G09G 3/3413; G09G 2360/16; G09G 3/3406; H04N 1/6027
See application file for complete search history.

(56) References Cited

U.S. PATENT DOCUMENTS

2006/0152468 A1* 7/2006 Ozaki ..... G09G 3/32 345/102
2008/0088557 A1* 4/2008 Choi ..... G09G 3/3413 345/88
2009/0027309 A1* 1/2009 Shikina ..... G09G 3/325 345/76
2009/0091528 A1* 4/2009 Hong ..... G09G 3/3406 345/102
2009/0096724 A1* 4/2009 Ichikawa ..... H05B 33/0869 345/82
2009/0122532 A1* 5/2009 Schevardo ..... H05B 33/086 362/231
2009/0284459 A1* 11/2009 Wallener ..... H05B 33/0851 345/102
2010/0045579 A1* 2/2010 Lu ..... G09G 3/3426 345/83
2010/0066264 A1* 3/2010 Kawata ..... H05B 33/086 315/291
2012/0262504 A1* 10/2012 Wang ..... G09G 3/3622 345/691
2012/0299979 A1* 11/2012 Murai ..... G09G 3/3426 345/690

FOREIGN PATENT DOCUMENTS

JP 2002-100485 A 4/2002
JP 2002-175067 A 6/2002
JP 2007-108602 A 4/2007
JP 2008-304539 A 12/2008

* cited by examiner

COLOR CONTROL METHOD

TECHNICAL FIELD

The present invention relates to color control methods, and specifically, to color control methods for color display devices that include a plurality of light-emitting elements with different colors.

BACKGROUND ART

Color display devices that include R, G, and B color LEDs as a plurality of light-emitting elements with different colors have been conventionally used, and shade correction devices and methods that correct the shade of the light emitted from LEDs have been proposed (e.g., see Patent Literature 1). The shade correction device described in Patent Literature 1 includes: a CPU that controls the lighting of LEDs; a ROM that stores, as tables, pieces of information regarding the values of currents flowing through R, G, and B LEDs; and a RAM that stores the values in one selected from the plurality of tables. This shade correction device is configured to correct the shade of the light emitted from the LEDs by selecting an optimal one of the tables.

Current control and pulse width modulation (PWM) control are known as methods of controlling the brightness of LEDs. In the PWM control, the duty ratio of a pulse waveform applied to each LED is changed whereby the brightness of the LEDs is modified. If the brightness of each color LED is changed to gradually modify a display color (e.g., fade in or fade out the display color), the relationship between the duty ratio and the changing time is used as a parameter for the PWM control. In general, a table that has been stored in, for example a ROM in advance is used as the above parameter. The changing rate of a duty ratio per time is defined in the table, and the brightness of each LED (display color) is modified on the basis of this changing ratio.

CITATION LIST

Patent Literature

Patent Literature 1: JP 2002-100485 A

SUMMARY OF INVENTION

Technical Problem

Unfortunately, conventional shade correction methods that use a relationship between a duty ratio and a changing time which has been stored in a table in advance may create an unnatural display. More specifically, when an arbitrary unmodified display color is modified to another modified display color, the difference in the changing rate of the duty ratio between the individual colors may cause a different system color to appear on the display color in the course of modification. To avoid such unnatural color modifications, a method by which the changing rate of a duty ratio is defined for each of the modification patterns of display colors and the parameters of these patterns are stored in a table is conceivable. This method, however, may create disadvantages in that it is necessary to: set a huge number of parameters; perform an inconvenient process for setting parameters; use a large capacity ROM; and perform complicated control for selecting parameters.

The present invention addresses disadvantages as described above with an object of providing a color control method that allows for a smooth modification of various display colors without using a huge number of parameters.

Solution to Problem

A color control method of the present invention described in a first aspect which addresses disadvantages as described above is a color control method for a color display device including a plurality of light-emitting elements with different colors. This color control method includes, when gradually modifying a display color by changing duty ratios of the light-emitting elements, determining duty ratios in the course of the modification (modified duty ratios Dn) through a calculation based on equation (1) and on the basis of a duty ratio before a color modification (pre-modified duty ratio Ds) and a duty ratio after the color modification (post-modified duty ratio Df). In the equation (1), A denotes a control constant, Td denotes a color modification time from a start to an end of the color modification, and Tn denotes an elapsed time from the start of the color modification, the elapsed time corresponding to each of the modified duty ratios Dn to be determined.

[Mathematical Formula 1]

$$Dn = \left\{A^{\frac{(Tn-Td)}{Td}} - \frac{(Td-Tn)}{Td}\cdot\frac{1}{A}\right\}\times(Df-Ds)+Ds \tag{1}$$

A color control method described in a second aspect is a color control method for a color display device including a plurality of light-emitting elements with different colors. This color control method includes, when gradually modifying a display color by changing duty ratios of the light-emitting elements, determining duty ratios in the course of the modification (modified duty ratios Dn) through a calculation based on equation (2) and on the basis of a duty ratio before a color modification (pre-modified duty ratio Ds) and a duty ratio after the color modification (post-modified duty ratio Df). In the equation (2), A denotes a control constant, Td denotes a color modification time from a start to an end of the color modification, and Tn denotes an elapsed time from the start of the color modification, the elapsed time corresponding to each of the duty ratios Dn in the course of the modification to be determined.

[Mathematical Formula 2]

$$Dn = \left\{A^{\frac{-Tn}{Td}} - \frac{Tn}{Td}\cdot\frac{1}{A}\right\}\times(Ds-Df)+Df \tag{2}$$

A color control method described in a third aspect is the color control method according to claim 1 or 2 in which the control constant A is set to an arbitrary value, the arbitrary value being selected so that brightnesses of the light-emitting elements change uniformly.

Advantageous Effects of Invention

According to the present invention, when a duty ratio is changed from a pre-modified duty ratio Ds to a post-modified duty ratio Df over a color modification time Td from the start to the end of a color modification, modified duty ratios Dn are calculated on the basis of equation (1) or equation (2). Consequently, it is possible to modify colors smoothly while reducing emergence of any unnatural color. Moreover, calculating modified duty ratios Dn by using equation (1) or (2) eliminates the need to set a parameter for each combination of a pre-modified duty ratio Ds and a post-modified duty ratio Df and the need to store those parameters as tables. Consequently, it is possible to perform color control by using control means and storage means with a simple configuration.

DESCRIPTION OF EMBODIMENTS

An embodiment of the present invention will be described below. A color control method of this embodiment is utilized for display control of a color display device that includes a plurality of light-emitting elements with different colors. Examples of such color display devices include a digital display unit for use in a gauge panel of an automobile. A digital display unit is configured to display various pieces of information in, for example a fuel gauge, a warning lamp, an indicator, an odometer, and a trip meter and includes: a display panel in which a plurality of LEDs as light-emitting elements are arrayed; an LED driver that controls a lighting signal to be applied to each LED; and a microcomputer that acts as control means for controlling the driving of the LED driver. The plurality of LEDs are LEDs with three colors, or R, G, and B, and the brightnesses of the individual LEDs are modified whereby a color display image is displayed on the display panel.

The microcomputer has a CPU, a ROM, a RAM and other memories. The CPU drives the LED driver by executing a program that has been stored in the ROM in advance, thereby modifying an image displayed on the display panel and changing the brightness of the display panel. The program stored in the ROM contains equations (1) and (2) that will be described later, and control constants A, duty ratios corresponding one-to-one to display colors, and the like that are to be used for these equations are also stored in the ROM. The LED driver receives a driving signal from the microcomputer and then applies lighting signals (pulse waveforms) with an appropriate duty ratio to the LEDs in accordance with the driving signal. In short, the microcomputer changes the brightnesses of the LEDs by changing the duty ratios of the pulse waveforms to be applied to the LEDs. With this PWM control, a display image having appropriate colors and brightness is displayed on the display panel.

Figure 1:
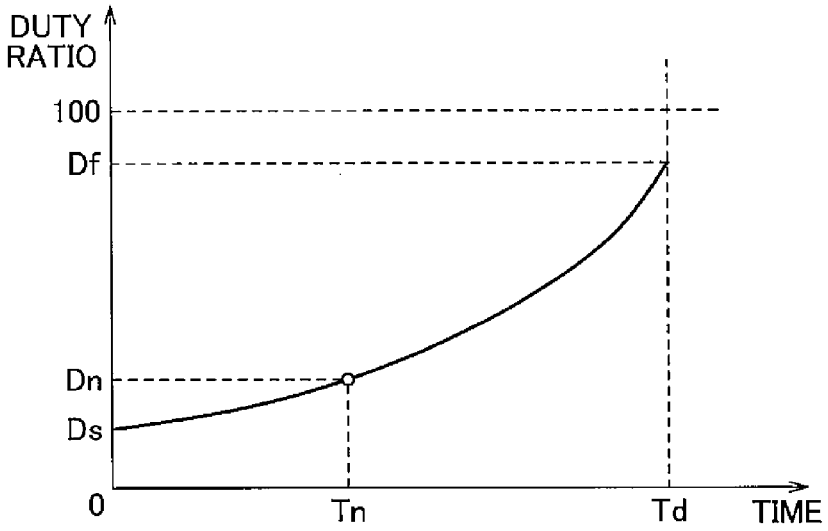
FIG. 1 is a graph showing a color control method according to an embodiment of the present invention.
Figure 2:
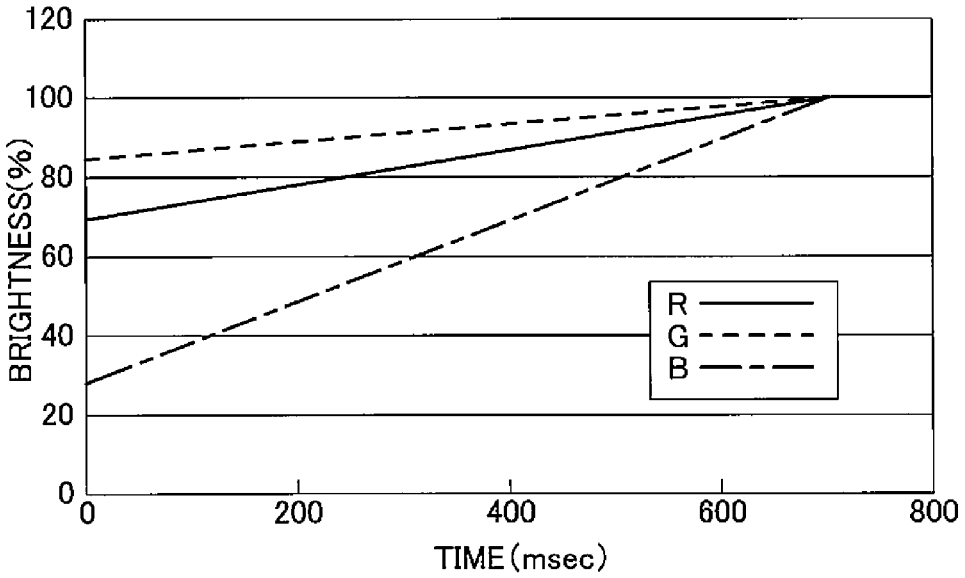
FIG. 2 is a graph showing a change in brightness according to Example 1 of the present invention.

Next, a color control method in which the brightness of each LED is controlled will be described on the basis of FIGS. 1 and 2. In this embodiment, when changing the duty ratio of each LED to gradually modify the display color, the CPU calculates a duty ratio that gradually changes over a period having a predetermined length, on the basis of duty ratios before and after the color modification. In other words, the CPU calculates a modified duty ratio Dn, on the basis of a pre-modified duty ratio Ds and a post-modified duty ratio Df. Then, the microcomputer controls the brightness of each LED on the basis of the calculated modified duty ratio Dn. Thereinafter, a description will be given of a fade-in process through which the R, G, and B color LEDs are gradually brightened and a fade-out process through which the R, G, and B color LEDs are gradually darkened. However, the color control method of the present invention is applicable to any other cases where the brightnesses (duty ratios) of the LEDs are modified with time, in addition to the fade-in and fade-out.

In the fade-in process, first, a pre-modified duty ratio Ds, a post-modified duty ratio Df that is brighter than the pre-modified duty ratio, and a color modification time Td that is the amount of time required for the modification which elapses from the start to the end of the modification are all set for each LED on the basis of the difference between the display colors before and after the color modification, and stored in the RAM. In addition, control constants A that have been set in advance in accordance with the fade-in process are read from the ROM to the RAM. Then, the CPU reads a program containing equation (1) given below which is stored in the ROM, and does calculations using equation (1), sequentially determining a modified duty ratio Dn at every elapsed time Tn that is the amount of time from the start of the color modification. The elapsed times Tn are set, for example at regular intervals from the start of the color modification (at multiple times of a PWM period). If the PWM frequency is 100 Hz, for example, the elapsed times Tn are set at every 10 msec, every 20 msec, or the like. The CPU outputs the duty ratios Dn in the course of the modification at the elapsed times Tn to the LED driver. When receiving the duty ratios Dn in the course of the modification that subsequently change, the LED driver applies pulse waveforms with these duty ratios to each LED, thereby controlling and driving each LED so as to be gradually brightened.

[Mathematical Formula 3]

$$Dn = \left\{A^{\frac{(Tn-Td)}{Td}} - \frac{(Td - Tn)}{Td} \cdot \frac{1}{A}\right\} \times (Df - Ds) + Ds \tag{1}$$

In the fade-in process described above, the control constants A are set to any values selected from the range from 20 to 50. Further, the control constants A for each of the R, G, and B color LEDs may be set to the same value or different values. Alternatively, calibration may be performed for each display panel whereby the control constants A are adjusted. The modified duty ratios Dn at the elapsed times Tn which have been calculated on the basis of the equation (1) become a graph increasing in the right direction (in the X-axis positive direction) and depressed in the downward direction (in the Y-axis negative direction), as shown in FIG. 1. Therefore, the PWM control is performed in such away that the changing rate (increasing rate) of the duty ratio gradually increases with time.

In the fade-out process, first, a pre-modified duty ratio Ds, a post-modified duty ratio Df that is darker than the pre-modified duty ratio, and a color modification time Td are all set for each LED and stored in the RAM. In addition, control constants A that have been set in advance in accordance with the fade-out process are read from the ROM to the RAM.

Then, the CPU reads a program containing equation (2) given below which is stored in the ROM, and does calculations using equation (2), sequentially determining a modified duty ratio Dn at every elapsed time Tn that is the amount of time from the start of the color modification and outputting the modified duty ratios Dn for the elapsed times Tn to the LED driver. When receiving the modified duty ratios Dn that subsequently change, the LED driver applies pulse waveforms with these duty ratios to each LED, thereby controlling and driving each LED so as to be gradually darkened.

[Mathematical Formula 4]

$$Dn = \left\{ A^{\frac{-Tn}{Td}} - \frac{Tn}{Td} \cdot \frac{1}{A} \right\} \times (Ds - Df) + Df \tag{2}$$

In the above fade-out process, the control constants A are constants to be set on the basis of characteristics of a light source so that the brightness of the light source changes uniformly. If LEDs are used as a light source as in this embodiment, the control constants A are set to, for example approximately 40 or any other values selected from the range from 20 to 50 depending on characteristics of the light source. Further, the control constants A may be set to the same values as or different values from those for the fade-in process. As in the case of the fade-in process, the control constants A for R, G, and B color LEDs may be set differently or calibrated and adjusted individually for each display panel. In the above fade-out process based on equation (2), the PWM control is performed in such away that the modified duty ratio Dn decreases with the elapsed time Tn and its changing rate (decreasing rate) gradually increases with the elapsed time Tn.

EXAMPLE

Examples and comparative examples of the present invention will be explained below. A fade-in process through which R, G, and B color LEDs are gradually brightened will be given as an exemplary case. In an initial state (unmodified state), a display panel was lighted with a greenish display color. Then, the brightness of the LEDs was modified such that the LEDs were gradually brightened. After the modification, white color was displayed.

Under the initial condition, the respective pre-modified duty ratio Ds of red (R), green (G), and blue (B) LEDs were set to 32.3%, 57.1%, and 5.8%, and the post-modified duty ratio Df of all the color LEDs was set to 100%. Furthermore, the color modification time Td was set to 700 msec (0.7 seconds), and the interval between elapsed times Tn was set to 50 msec (0.05 seconds).

Since the fade-in process was employed in the example (Example 1), equation (1) was used and the control constants A were set to 40 (A=40). The result of calculating the modified duty ratios Dn of the R, G, and B color LEDs at every elapsed time Tn is listed in Table 1 described below. The changes in the brightnesses of the color LEDs controlled on the basis of the duty ratios in Table 1 are shown in the graph of FIG. 2.

TABLE 1

Exemplary control upon color modification (Example 1)
Time (msec)
EXEMPLARY CONTROL
UPON COLOR MODIFICATION(EXAMPLE 1)

| TIME | DUTY (%) | | |
|---|---|---|---|
| (msec) | R | G | B |
| 0 | 32.3 | 57.1 | 5.8 |
| 50 | 32.9 | 57.5 | 7.5 |
| 100 | 33.7 | 58.0 | 9.4 |
| 150 | 34.7 | 58.6 | 11.8 |
| 200 | 35.9 | 59.4 | 14.6 |
| 250 | 37.5 | 60.4 | 17.9 |
| 300 | 39.6 | 61.7 | 21.9 |
| 350 | 42.2 | 63.3 | 26.6 |
| 400 | 45.5 | 65.5 | 32.3 |
| 450 | 49.8 | 68.2 | 39.1 |
| 500 | 55.4 | 71.7 | 47.3 |
| 550 | 62.6 | 76.3 | 57.1 |
| 600 | 72.0 | 82.3 | 68.9 |
| 650 | 84.2 | 90.0 | 83.0 |
| 700 | 100.0 | 100.0 | 100.0 |

Next, in the comparative examples (Comparative Examples 1 and 2), first, a table listed in Table 2 described below was used as a reference of a changing rate of a duty ratio per time. Then, the modified duty ratio Dn of each color LED was calculated on the basis of the changing rate of the duty ratio. In this table, the changing rate at which the duty ratio is changed from 0% to 100% in 1000 msec (1 second) is set.

TABLE 2

Exemplary table (Comparative Example)
Time (msec)
TABLE 2 EXEMPLARY TABLE
(COMPARATIVE EXAMPLE)

| TIME (msec) | DUTY (%) |
|---|---|
| 0 | 0.0 |
| 50 | 0.6 |
| 100 | 1.4 |
| 150 | 2.2 |
| 200 | 3.2 |
| 250 | 4.4 |
| 300 | 5.8 |
| 350 | 7.5 |
| 400 | 9.4 |
| 450 | 11.8 |
| 500 | 14.6 |
| 550 | 17.9 |
| 600 | 21.9 |
| 650 | 26.6 |
| 700 | 32.3 |
| 750 | 39.1 |
| 800 | 47.3 |
| 850 | 57.1 |
| 900 | 68.9 |
| 950 | 83.0 |
| 1000 | 100.0 |

Figure 3:
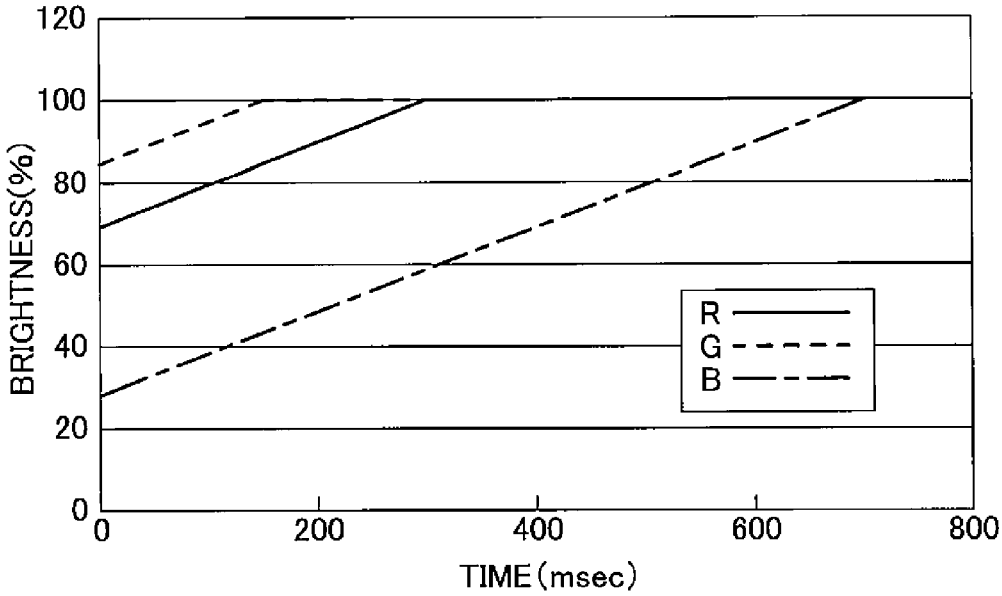
FIG. 3 is a graph showing a change in brightness according to Comparative Example 1.

In Comparative Example 1, the duty ratios of the color (R, G, and B) LEDs were changed on the basis of the changing rate of the duty ratio defined in Table 2, as shown in Table 3. The change in the brightness of each color LED is shown in the graph of FIG. 3 as the result of changing the duty ratio.

TABLE 3

Exemplary control upon color modification (Comparative Example 1)
Time (msec)
TABLE 3 EXEMPLARY CONTROL UPON COLOR MODIFICATION (COMPARATIVE EXAMPLE1)

| TIME | DUTY (%) | | |
|---|---|---|---|
| (msec) | R | G | B |
| 0 | 32.3 | 57.1 | 5.8 |
| 50 | 39.1 | 68.9 | 7.5 |
| 100 | 47.3 | 83.0 | 9.4 |
| 150 | 57.1 | 100.0 | 11.8 |
| 200 | 68.9 | 100.0 | 14.6 |
| 250 | 83.0 | 100.0 | 17.9 |
| 300 | 100.0 | 100.0 | 21.9 |
| 350 | 100.0 | 100.0 | 26.6 |
| 400 | 100.0 | 100.0 | 32.3 |
| 450 | 100.0 | 100.0 | 39.1 |
| 500 | 100.0 | 100.0 | 47.3 |
| 550 | 100.0 | 100.0 | 57.1 |
| 600 | 100.0 | 100.0 | 68.9 |
| 650 | 100.0 | 100.0 | 83.0 |
| 700 | 100.0 | 100.0 | 100.0 |

In Comparative Example 1, the color modification time was set to 700 msec, because according to the Table 1, the blue (B) LED that had a duty ratio of 5.8%, or the lowest duty ratio, before the modification (at the time of 0), needed 700 msec until its duty ratio reached 100%. The duty ratio of the red (R) LED that had a duty ratio of 32.3% before the modification (at the time of 0) reached 100% in 300 msec, after which the duty ratio was kept 100% till 700 msec. The duty ratio of the green (G) LED that had a duty ratio of 57.1% before the modification (at the time of 0) reached 100% in 150 msec, after which the duty ratio was kept 100% till 700 msec.

When the duty ratios are changed by using the table shown in Table 2 as a reference and the brightness of the display color is modified as in Comparative Example 1, the brightness ratio of the individual color LEDs varies in the course of the modification. Consequently, colors whose hue differs from that of the unmodified color may appear. In other words, abnormal intermediate colors may be created, that is, different system colors may appear in the course of the fade-in. In this case, a user might feel that the display color is unnatural.

Figure 4:
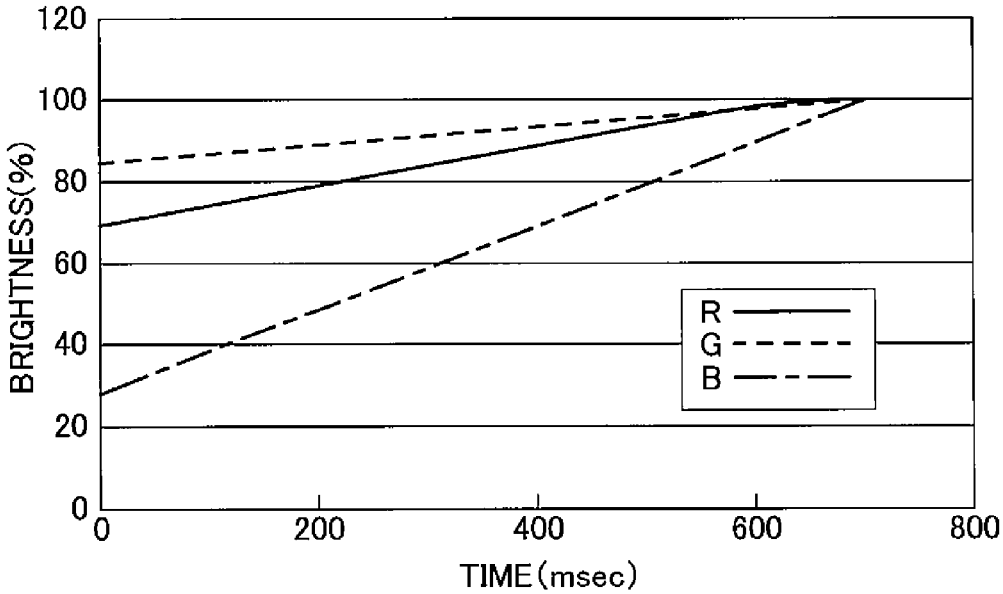
FIG. 4 is a graph showing a change in brightness according to Comparative Example 2.

In Comparative Example 2, the duty ratios of the color (R, G, and B) LEDs defined in Table 2 were modified to those in Table 4 on the basis of values obtained by subjecting the duty ratios in Table 2 to the first-order approximation complementary. As a result of modifying the duty ratios in this manner, a change in the brightness of each color LED is shown in the graph of FIG. 4. Here, in the first-order approximation complementary, the number of pieces of data (15) corresponding to the color modification time (700 msec) is compared with the number of pieces of data on the duty ratios defined in Table 2 (e.g., 7 pieces of data on the red (R) LED are present in the range from 32.3% to 100%). If an insufficient number of pieces of data are defined as the duty ratios, data values are complemented between duty ratios with the first-order approximation. This complementation is repeated until the duty ratio becomes 100%.

TABLE 4

Exemplary control upon color modification (Comparative Example 2)
Time (msec)
TABLE 4 EXEMPLARY CONTROL UPON COLOR MODIFICATION (COMPARATIVE EXAMPLE2)

| TIME | DUTY (%) | | |
|---|---|---|---|
| (msec) | R | G | B |
| 0 | 32.3 | 57.1 | 5.8 |
| 50 | 35.2 | 59.6 | 7.5 |
| 100 | 38.1 | 62.2 | 9.4 |
| 150 | 42.0 | 64.7 | 11.8 |
| 200 | 46.0 | 67.2 | 14.6 |
| 250 | 50.8 | 69.7 | 17.9 |
| 300 | 55.5 | 73.1 | 21.9 |
| 350 | 61.2 | 76.5 | 26.6 |
| 400 | 67.0 | 79.9 | 32.3 |
| 450 | 73.9 | 83.2 | 39.1 |
| 500 | 80.7 | 86.8 | 47.3 |
| 550 | 89.0 | 90.4 | 57.1 |
| 600 | 97.2 | 94.0 | 68.9 |
| 650 | 100.0 | 97.6 | 83.0 |
| 700 | 100.0 | 100.0 | 100.0 |

Figure 5:
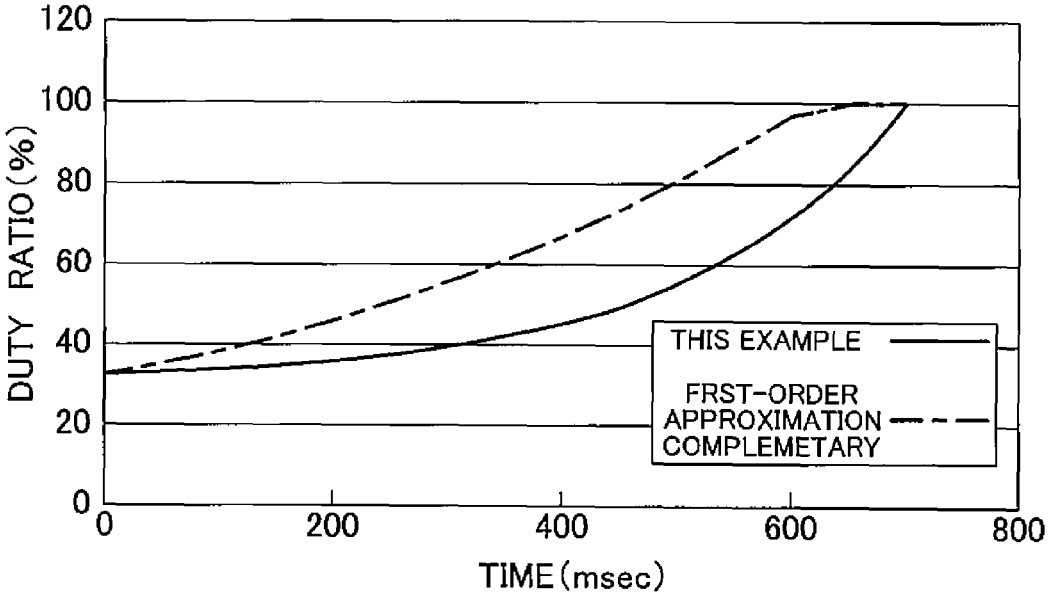
FIG. 5 is a graph showing changes in duty ratios of Example 1 and Comparative Example 2.

In Comparative Example 2, since data values between the duty ratios defined in Table 2 are calculated with the repletion of the first-order approximation complementary, an interpolation error may be generated: for example, the duty ratio approaches 100% at an early stage with respect to the color modification time as indicated by the dashed line in FIG. 5. Such interpolation errors might degrade smoothness of a color modification. In contrast to this, Example 1 of the present invention uses equation (1) to calculate modified duty ratios Dn. This calculation can change duty ratios smoothly without creating errors in the course of changing the duty ratios, as indicated by a solid line in FIG. 5. Consequently, the brightness of each color LED is changed linearly as shown in FIG. 2. Therefore, a fade-in process that enables a user to have natural perception can be achieved.

In this example, the explanation has been given regarding the case where the method of calculating modified duty ratios Dn by using equation (1) is applied to a fade-in process. Likewise, the method of calculating modified duty ratios Dn by using equation (2) may be applied to a fade-out process. This calculation can change duty ratios smoothly without creating abnormal intermediate colors unlike Comparative Example 1 and without generating interpolation errors unlike Comparative Example 2. Consequently, the brightness of each color LED is changed linearly, and a fade-out process that enables a user to have natural perception can be achieved.

Next, an explanation will be given of data size Dsize required to perform a fade-in process through which R, G, and B color LEDs that have not been lighted are gradually brightened and then a predetermined display color is lighted on a display panel while emergence of different system colors is reduced.

First, a color modification time Td was set to 1000 msec (1 second), and the intervals between elapsed times Tn was set to 50 msec (0.05 seconds); the fade-in process was performed at 21 steps.

Since Example 2 was applied to a fade-in process, equation (1) was used to calculate duty ratios Dn when control constants A were set to 40 (A=40), and then these duty ratios Dn were set as reference duties Dns. The reference duties Dns were multiplied by predetermined constants BR, BG, and BB corresponding to R, G, and B, respectively, so that the same display color was obtained at the individual steps.

In the display color of this example, each reference duty Dns was multiplied by 0.3162, 0.6343, and 0.6813. In this way, the duty ratios Dn for the individual colors were calculated. These results are shown in Table 5.

TABLE 5

Time-DUTY characteristics upon fade-in (Example 2)
Time (msec)
Reference duty
TABLE 5 TIME-DUTY CHARACTERISTICS UPON FADE-IN(EXAMPLE2)

| STEP | TIME (msec) | REFERENCE DUTY | DUTY (%) R | G | B |
|---|---|---|---|---|---|
| 1 | 0 | 0.00 | 0.00 | 0.00 | 0.00 |
| 2 | 50 | 0.63 | 0.20 | 0.40 | 0.43 |
| 3 | 100 | 1.37 | 0.43 | 0.87 | 0.93 |
| 4 | 150 | 2.22 | 0.70 | 1.41 | 1.51 |
| 5 | 200 | 3.23 | 1.02 | 2.05 | 2.20 |
| 6 | 250 | 4.41 | 1.40 | 2.80 | 3.01 |
| 7 | 300 | 5.81 | 1.84 | 3.69 | 3.96 |
| 8 | 350 | 7.47 | 2.36 | 4.74 | 5.09 |
| 9 | 400 | 9.43 | 2.98 | 5.98 | 6.43 |
| 10 | 450 | 11.77 | 3.72 | 7.47 | 8.02 |
| 11 | 500 | 14.56 | 4.60 | 9.24 | 9.92 |
| 12 | 550 | 17.89 | 5.66 | 11.35 | 12.19 |
| 13 | 600 | 21.87 | 6.91 | 13.87 | 14.90 |
| 14 | 650 | 26.62 | 8.42 | 16.89 | 18.14 |
| 15 | 700 | 32.32 | 10.22 | 20.50 | 22.02 |
| 16 | 750 | 39.14 | 12.38 | 24.83 | 26.67 |
| 17 | 800 | 47.32 | 14.96 | 30.01 | 32.24 |
| 18 | 850 | 57.13 | 18.06 | 36.24 | 38.92 |
| 19 | 900 | 68.90 | 21.79 | 43.70 | 46.94 |
| 20 | 950 | 83.03 | 26.25 | 52.67 | 56.57 |
| 21 | 1000 | 100.00 | 31.62 | 63.43 | 68.13 |

Pieces of information required to perform the fade-in process of Example 2 are a reference duty Dns and constants BR, BG, and BB at each step. The data size of each of the duty ratio Dn and the constants BR, BG, and BB for one step corresponds to 2 bytes; the data size of the reference duties Dns for 21 steps is 42 bytes. If a fade-in process is performed with an N number of display colors, each of the three constants BR, BG, and BB for each display color corresponds to 2 bytes, and the data size of the constants BR, BG, and BB is 6N. Therefore, the data size required to perform the fade-in process of Example 2 is 6N+42.

In Comparative Example 3, the R, G, and B color LEDs are lighted at duty ratios Dn shown in Table 6 in order to reduce emergence of different system colors during the fade-in process, similar to Example 2.

TABLE 6

Time-DUTY characteristics upon fade-in (Example 3)
Time (msec)
TABLE 6 TIME-DUTY CHARACTERISTICS UPON FADE-IN(COMPARATIVE EXAMPLE3)

| STEP | 時間 (msec) | DUTY (%) R | G | B |
|---|---|---|---|---|
| 1 | 0 | 0.00 | 0.00 | 0.00 |
| 2 | 50 | 0.20 | 0.40 | 0.43 |
| 3 | 100 | 0.43 | 0.87 | 0.93 |
| 4 | 150 | 0.70 | 1.41 | 1.51 |
| 5 | 200 | 1.02 | 2.05 | 2.20 |
| 6 | 250 | 1.40 | 2.80 | 3.01 |
| 7 | 300 | 1.84 | 3.69 | 3.96 |
| 8 | 350 | 2.36 | 4.74 | 5.09 |

TABLE 6-continued

Time-DUTY characteristics upon fade-in (Example 3)
Time (msec)
TABLE 6 TIME-DUTY CHARACTERISTICS UPON FADE-IN(COMPARATIVE EXAMPLE3)

| STEP | 時間 (msec) | DUTY (%) R | G | B |
|---|---|---|---|---|
| 9 | 400 | 2.98 | 5.98 | 6.43 |
| 10 | 450 | 3.72 | 7.47 | 8.02 |
| 11 | 500 | 4.60 | 9.24 | 9.92 |
| 12 | 550 | 5.66 | 11.35 | 12.19 |
| 13 | 600 | 6.91 | 13.87 | 14.90 |
| 14 | 650 | 8.42 | 16.89 | 18.14 |
| 15 | 700 | 10.22 | 20.50 | 22.02 |
| 16 | 750 | 12.38 | 24.83 | 26.67 |
| 17 | 800 | 14.96 | 30.01 | 32.24 |
| 18 | 850 | 18.06 | 36.24 | 38.92 |
| 19 | 900 | 21.79 | 43.70 | 46.94 |
| 20 | 950 | 26.25 | 52.67 | 56.57 |
| 21 | 1000 | 31.62 | 63.43 | 68.13 |

In Comparative Example 3, to perform a fade-in process with one display color, information regarding all the duty ratios Dn shown in Table 6 is needed. In other words, the duty ratios Dn for three R, G, and B colors are needed for each of 21 steps. Therefore, 63 duty ratios Dn are needed, in which case the data size is 126 bytes. In addition, the resultant data size is multiplied by N in order to perform the fade-in process with an N number of display colors. The data size Dsize required to perform the fade-in process of Comparative Example 3 is 126N.

Assuming that N is an arbitrary natural number, Example 2 requires a smaller data size Dsize than Comparative Example 3. The difference in necessary data size Dsize increases as the number of display colors increases.

The data sizes Dsize required to perform the fade-in process of Example 2 and Comparative Example 3 have been described. The data sizes Dsize required to perform the fade-out processes of Example 2 and Comparative Example 3 are also substantially the same as those described above.

According to this embodiment described above, when a duty ratio is changed from a pre-modified duty ratio Ds to a post-modified duty ratio Df over a color modification time Td from the start to the end of a color modification, modified duty ratios Dn are calculated on the basis of equation (1) upon a fade-in process and equation (2) upon a fade-out process. Consequently, it is possible to modify colors smoothly while reducing emergence of any unnatural color. Moreover, calculating modified duty ratios Dn by using equation (1) or (2) eliminates the need to set a parameter for each combination of a pre-modified duty ratio Ds and a post-modified duty ratio Df and the need to store those parameters as tables. Consequently, it is possible to decrease a necessary data size Dsize and perform color control by using control means and storage means with a simple configuration.

In the foregoing embodiment, control constants A in equations (1) and (2) to be used to calculate modified duty ratios Dn of individual color LEDs are set to 40; however, different control constants A may be used for different color LEDs. If LEDs vary in brightness, different correction parameters may be set to individual LEDs, and the correction parameters may be added to equations (1) and (2) or control constants A. In the foregoing embodiment, a color control applied to a color display panel having R, G, and B color LEDs has been described; however, the colors of LEDs are not limited to three colors, or R, G, and B and any other colors and any number of colors may be used. A Light-emitting element is not limited to only a light emitting diode (LED) but any type of element such as a semiconductor laser is available.

REFERENCE SIGNS LIST

A control constant
Df post-modified duty ratio
Dn modified duty ratio
Ds pre-modified duty ratio
Td color modification time
Tn elapsed time

The invention claimed is:

1. A color control method for a color display device including a plurality of light-emitting elements with different colors, the color control method comprising:

when gradually modifying a display color by changing duty ratios of the light-emitting elements, determining duty ratios in the course of the modification (modified duty ratios Dn) through a calculation based on equation (1) and on the basis of a duty ratio before a color modification (pre-modified duty ratio Ds) and a duty ratio after the color modification (post-modified duty ratio Df), $$Dn = \left\{A^{\frac{(Tn-Td)}{Td}} - \frac{(Td-Tn)}{Td}\cdot\frac{1}{A}\right\}\times(Df-Ds)+Ds \quad (1)$$

wherein in the equation (1), A denotes a control constant, Td denotes a color modification time from a start to an end of the color modification, and Tn denotes an elapsed time from the start of the color modification, the elapsed time corresponding to each of the duty ratios Dn in the course of the modification to be determined.

2. The color control method according to claim 1, wherein the control constant A is set to an arbitrary value, the arbitrary value being selected so that brightnesses of the light-emitting elements change uniformly.

3. A color control method for a color display device including a plurality of light-emitting elements with different colors, the color control method comprising:

when gradually modifying a display color by changing duty ratios of the light-emitting elements, determining duty ratios in the course of the modification (modified duty ratios Dn) through a calculation based on equation (2) and on the basis of a duty ratio before a color modification (pre-modified duty ratio Ds) and a duty ratio after the color modification (post-modified duty ratio Df), $$Dn = \left\{A^{\frac{-Tn}{Td}} - \frac{Tn}{Td}\cdot\frac{1}{A}\right\}\times(Ds-Df)+Df \quad (2)$$

wherein in the equation (2), A denotes a control constant, Td denotes a color modification time from a start to an end of the color modification, and Tn denotes an elapsed time from the start of the color modification, the elapsed time corresponding to each of the duty ratios Dn in the course of the modification to be determined.

4. The color control method according to claim 3, wherein the control constant A is set to an arbitrary value, the arbitrary value being selected so that brightnesses of the light-emitting elements change uniformly.

* * * * *